US005613735A

United States Patent [19]

Goiset

[11] Patent Number: 5,613,735

[45] Date of Patent: Mar. 25, 1997

[54] ADJUSTABLE ARMCHAIR

[76] Inventor: Paul Goiset, 4, rue des Carrouges, 91800 Brunoy, France

[21] Appl. No.: 508,066

[22] Filed: Jul. 27, 1995

[30] Foreign Application Priority Data

Feb. 23, 1995 [FR] France ..... 95 02118

[51] Int. Cl.[6] ..... A47C 1/00

[52] U.S. Cl. ..... 297/362.13; 297/313; 297/411.2

[58] Field of Search ..... 297/340, 316, 297/323, 463.1, 337, 354.12, 361.1, 362.12, 362.13, 411.2, 411.35, 411.39, 359, 360, 286, 78, 27, 28

[56] References Cited

U.S. PATENT DOCUMENTS

| | | | |
|---|---|---|---|
| 2,603,273 | 7/1952 | Gambrill | 297/323 X |
| 2,620,020 | 12/1952 | Austin | 297/340 |
| 2,655,201 | 10/1953 | Lorenz | 297/323 X |
| 3,140,119 | 7/1964 | Offner | 297/411.35 X |
| 4,370,001 | 1/1983 | Örnberg | 297/362.13 |
| 5,281,001 | 1/1994 | Bergsten et al. | 297/411.35 X |

*Primary Examiner*—Milton Nelson, Jr.

*Attorney, Agent, or Firm*—Wolf, Greenfield & Sacks, P.C.

[57] ABSTRACT

An adjustable armchair is provided that includes a frame, a seat portion, a back portion and a pair of armrests. The seat portion, back portion and pair of armrests are mounted to the frame. The armchair also includes a drive mechanism coupled to the frame and at least one of the seat portion and the back portion which is arranged to drive the at least one of the seat portion and the back portion to pivot on the frame, and a control mechanism coupled to the drive mechanism which is arranged to actuate the drive mechanism. The control mechanism includes at least one of the pair of armrests which is moveably mounted to the frame, and the drive mechanism is actuated when the armrest is moved on the frame.

10 Claims, 2 Drawing Sheets

ADJUSTABLE ARMCHAIR

SUMMARY OF THE INVENTION

The armchair according to the invention comprises a framework supporting a seat part, a back part and two armrests, the seat part and/or the back part being disposed to pivot under the action of a drive means which is actuated by a control means, the armchair being characterised in that the control means consists of an arm rest which is mounted in a movable manner on the framework and which is connected to the abovementioned drive means so as to trigger this during the movement of the armrest.

According to a further feature of the invention, the arm rest is mounted in a sliding manner on the framework.

According to a further feature of the invention the two armrests are arranged in a movable manner, one of them constituting the control means for displacing the sitting part, and the other constituting the control means for displacing the back part.

According to a further feature of the invention, the arm rest is supported in a sliding manner by the framework by means of two parallel rods.

According to a further feature of the invention, a spring is disposed between the arm rest and the framework to return the arm rest into its initial position after the displacement control thereof.

The invention is shown by way of non-limiting example in the attached drawings.

DETAILED DESCRIPTION OF THE INVENTION

Figure 1:
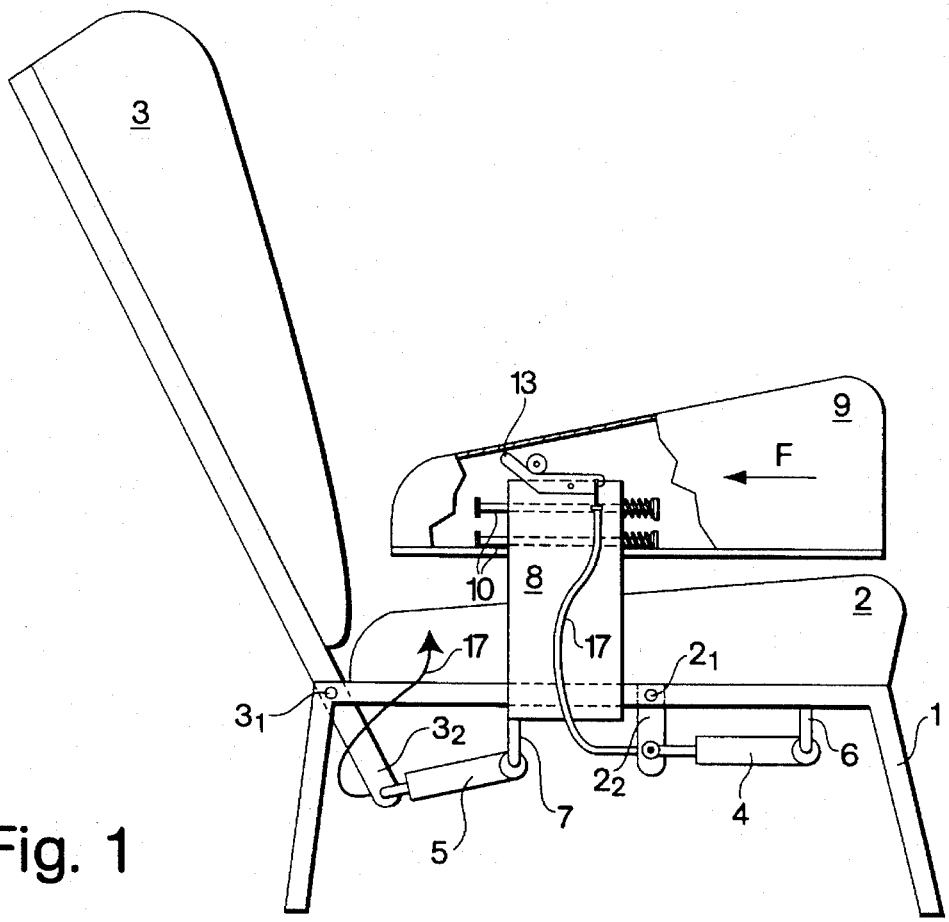
FIG. 1 is a partially cut away side view of an armchair according to the invention.
Figure 2:
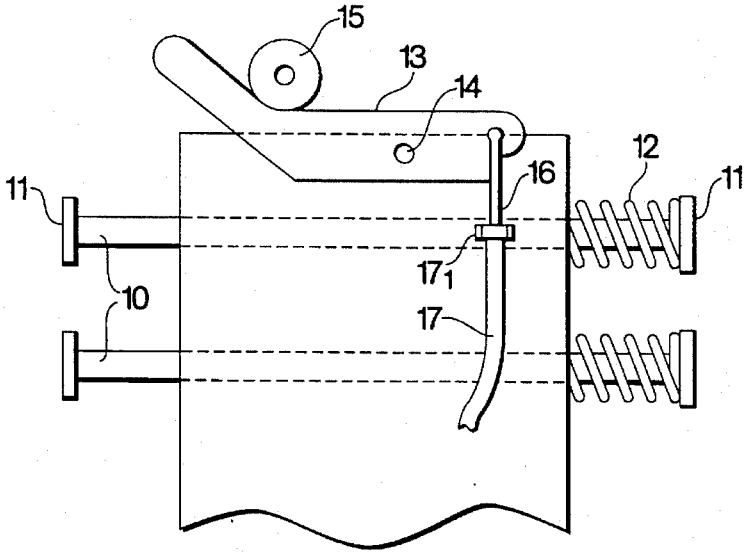
FIG. 2 is a partial enlarged view of FIG. 1.
Figure 3:
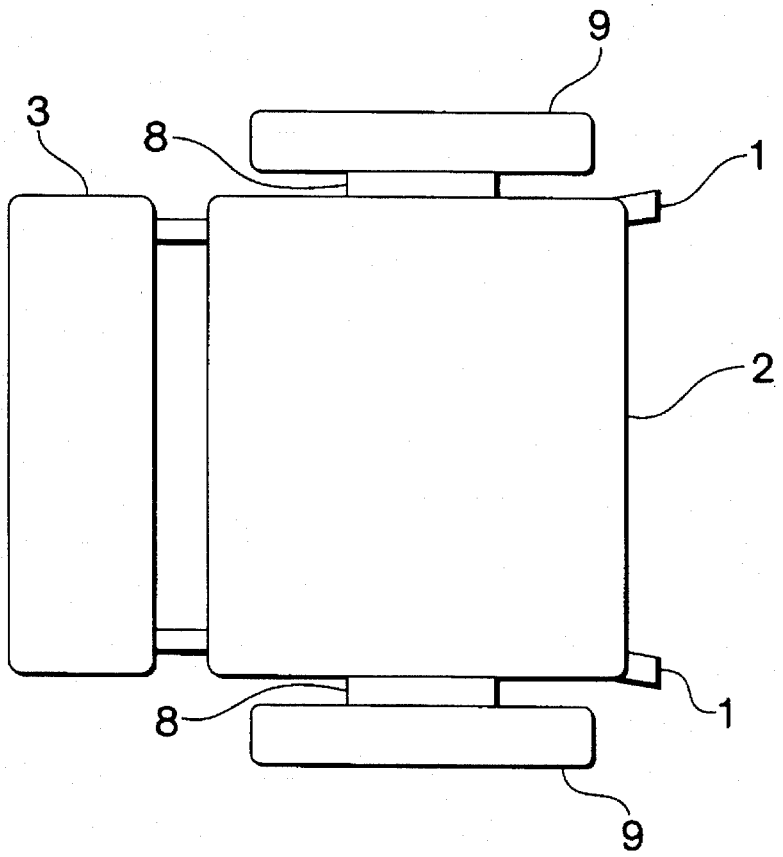
FIG. 3 is a top plan view of FIG. 1.

The object of the present invention is therefore to produce an armchair of which the seat part and/or the back part, which are mounted in a pivoting manner may easily be adjusted as regards the angle of inclination by a simple maneuver performed by the person who is occupying this seat and without the person needing to alter the position he or she is occupying.

The seat shown in the attached drawings thus comprises a frame 1 which is in general tubular, on which there is mounted a sitting part 2 and a back part 3.

The seat part 2 and back part 3 are, respectively, mounted in a pivoting manner on the framework 1 by means of the shafts $\mathbf{2}_1$ and $\mathbf{3}_1$.

These seat and back parts, 2 and 3 are extended by tabs $\mathbf{2}_2$ and $\mathbf{3}_2$ by means of which they are connected in an articulated manner to spring pneumatic jacks 4 and 5 which are, themselves, supported in an articulated manner by the framework 1 by means of stirrups 6 and 7.

On the framework 1 there is likewise secured a U-shaped structure 8 which passes below the seat part 2 and the two branches of which support the armrests 9.

Each arm rest 9 is integral with two parallel rods 10 by means of two tabs 11, these rods 10 being mounted in a sliding manner in the interior of the U-shape structure 8.

The springs 12 are disposed about the rods 10 between the tabs 11 and the U-shaped structure 8 in such a manner that, after a sliding control of an armrest in the direction of the arrow F towards the back 3, these springs 12 automatically return the arm rest to its original projecting position.

At the free end of each of the branches of the U-shaped structure 8 there is a curved lever 13. This lever 13 pivots on the U-shaped structure by means of a shaft 14 and co-operates with a roller 15 mounted in rotation on each of the armrests 9.

Each lever 13 is, furthermore, connected to a cable 16 disposed in a sleeve 17, the cable stop $\mathbf{17}_1$ of which is secured to the U-shaped structure 8.

Each cable is, furthermore, connected to one of the jacks 4 or 5, in such a manner that, during the sliding of one of the armrests towards the rear in the direction of the arrow F, the corresponding roller 15 causes its lever 13 to pivot in such a manner as to exert traction on the cable 16. This traction on the cable 16 thus triggers the jack 4 or 5 in such a manner as to control the pivoting of the seat part 2 or the back part 3.

It should also be noted that, as a result of this construction, the person seated on the armchair may, substantially without moving and by only exerting a slight traction movement on one of the armrests, control the tilting of the corresponding part of the sitting part or seat.

When the operator stops exerting the traction movement on the arm rest, the spring 12 returns the armrest to its original position in such a manner that the roller 15 allows the lever 13 likewise to pivot to its original position, thereby releasing the traction on the cable 16 causing the locking of the jack and thus the locking of the jack of the seat part or sitting part in the selected position.

In the example shown, the jacks 4 and 5 are single-action jacks. According to a further embodiment, these jacks may, however, be double-action jacks in order that they may control the seat parts and/or sitting parts in a pivoting manner in the two directions from a central position.

In this case, the springs 12 are disposed about the two ends of each rod 10 in order to maintain the armrests in a median position of equilibrium from which the person occupying the seat may control the tilting of the seat part or the back part in a desired direction by pulling the armrests in the direction of the arrow F or pushing them in the opposite direction.

What is claimed is:

1. An adjustable armchair comprising:

a frame;

a seat portion mounted to the frame;

a back portion mounted to the frame;

a pair of armrests mounted to the frame;

a drive mechanism coupled to the frame and at least one of the seat portion and the back portion, the drive mechanism being arranged to drive the at least one of the seat portion and the back portion to pivot on the frame; and a control mechanism including at least one of the pair of armrests movably mounted to the frame independent of the back portion, the control mechanism being coupled to the drive mechanism and being arranged to actuate the drive mechanism when the at least one of the pair of armrests is moved on the frame.

2. The adjustable armchair as recited in claim 1, wherein the at least one of the pair of armrests is slidably mounted to the frame in a first direction between a first position and a second position, the drive mechanism being arranged to be actuated when the at least one of the pair of armrests is slid to the second position.

3. The adjustable armchair as recited in claim 2, wherein the control mechanism includes a pair of parallel rods slidably mounted to the frame, the at least one of the pair of armrests being mounted to the pair of parallel rods, the pair of parallel rods extending in the first direction.

4. The adjustable armchair as recited in claim 2, wherein the at least one of the pair of armrests is arranged to be slid toward the back portion to the second position to actuate the drive mechanism.

5. An adjustable armchair comprising:

a frame;

a seat portion mounted to the frame;

a back portion mounted to the frame;

a pair of armrests mounted to the frame;

a drive mechanism coupled to the frame and at least one of the seat portion and the back portion, the drive mechanism being arranged to drive the at least one of the seat portion and the back portion to pivot on the frame; and a control mechanism including at least one of the pair of armrests slidably mounted to the frame in a first direction between a first position and a second position and a spring disposed between the at least one of the pair of armrests and the frame, the spring being arranged to bias the at least one of the pair of armrests toward the first position, the control mechanism being coupled to the drive mechanism and being arranged to actuate the drive mechanism when the at least one of the pair of armrests is slid to the second position.

6. An adjustable armchair comprising:

a frame;

a seat portion mounted to the frame;

a back portion mounted to the frame;

a pair of armrests mounted to the frame;

a drive mechanism coupled to the frame and at least one of the seat portion and the back portion the drive mechanism being arranged to drive the at least one of the seat portion and the back portion to pivot on the frame; and a control mechanism including at least one of the pair of armrests movably mounted to the frame and a control cable coupled to the at least one of the pair of armrests and to the drive mechanism, the control mechanism being arranged to actuate the drive mechanism when the at least one of the pair of armrests is moved on the frame.

7. The adjustable armchair as recited in claim 6, wherein the control mechanism includes a roller mounted to the at least one of the pair of armrests and a lever pivotally connected to the frame, the roller being arranged to engage the lever and the control cable being connected to the lever.

8. An adjustable armchair comprising:

a frame;

a seat portion mounted to the frame;

a back portion mounted to the frame:

a pair of armrests mounted to the frame;

a drive mechanism coupled to the frame and including a jack coupled to at least one of the seat portion and the back portion, the drive mechanism being arranged to drive the at least one of the seat portion and the back portion to pivot on the frame; and a control mechanism including at least one of the pair of armrests movably mounted to the frame, the control mechanism being coupled to the jack and being arranged to actuate the jack when the at least one of the pair of armrests is moved on the frame.

9. The adjustable armchair as recited in claim 8, wherein the jack is a spring pneumatic jack.

10. The adjustable armchair as recited in any of claims 1–9, wherein the drive mechanism includes a first drive mechanism arranged to drive the seat portion and a second drive mechanism arranged to drive the back portion, and wherein the control mechanism includes a first control mechanism coupled to the first drive mechanism and a second control mechanism coupled to the second drive mechanism, the first control mechanism including one of the pair of armrests and the second control mechanism including the other of the pair of armrests.

* * * * *

UNITED STATES PATENT AND TRADEMARK OFFICE

CERTIFICATE OF CORRECTION

PATENT NO. : 5,613,735

DATED : March 25, 1997

INVENTOR(S) : Paul Goiset

It is certified that error appears in the above-indentified patent and that said Letters Patent is hereby corrected as shown below:

On the Title page, under "References Cited:, add the following references:

| | | | |
|---|---|---|---|
| 488,911 | 12/1892 | Weber | 297/360XR |
| 1,970,480 | 8/1934 | Wood | 297/359 |
| 2,099,460 | 11/1937 | Bell | 297/359XR |
| 3,276,816 | 10/1966 | Edwards | 297/359 |
| 3,610,651 | 10/1971 | Jackson | 297/359XR |
| 3,883,174 | 5/1975 | Roscoe | 297/360XR |
| 4,887,866 | 12/1989 | Rusin | 297/360XR |

In claim 6, column 3, line 41, insert --,-- between "portion" and "the".

Signed and Sealed this

Eighth Day of July, 1997

Bruce Lehman

*Attest:*

BRUCE LEHMAN

*Attesting Officer*

*Commissioner of Patents and Trademarks*